United States Patent [19]

Wendt

[11] Patent Number: 4,944,122

[45] Date of Patent: Jul. 31, 1990

[54] HORIZONTALLY ORIENTED DEMOUNTABLE PARTITION SYSTEM

[76] Inventor: Alan C. Wendt, 249 S. Poteet Rd., Barrington, Ill. 60010

[21] Appl. No.: 253,161

[22] Filed: Oct. 4, 1988

[51] Int. Cl.[5] ..... A47B 5/00

[52] U.S. Cl. ..... 52/36; 52/461; 52/465; 52/710

[58] Field of Search ..... 52/36, 729, 481, 376, 52/461, 463, 465, 466, 710, 287, 242

[56] References Cited

U.S. PATENT DOCUMENTS

| | | | |
|---|---|---|---|
| 2,158,732 | 5/1939 | Shannon | 52/461 |
| 3,574,985 | 4/1971 | Pierce | 52/463 |
| 3,667,174 | 6/1972 | Arnett | 52/710 X |
| 3,688,460 | 9/1972 | Van Loghem et al. | 52/466 |
| 3,971,075 | 7/1976 | Heinbaugh et al. | 52/461 X |
| 4,570,390 | 2/1986 | Wendt | 52/36 |
| 4,583,333 | 4/1986 | Minter | 52/465 X |
| 4,671,038 | 6/1987 | Porter | 52/465 X |
| 4,731,960 | 3/1988 | Sease | 52/36 |

*Primary Examiner*—David A. Scherbel
*Assistant Examiner*—Creighton Smith

[57] ABSTRACT

A demountable partition system is provided having horizontally oriented panels and bands for wire management and attachment of wall supported furniture. In the system, a horizontal runner has upper and lower edges engaging wall panels disposed above and below. A recess is formed in the runner between the upper and lower edges and a cap engages the runner and covers the recess. The runner may be used to route and conceal wiring and to support hang-on furniture at any location along the length of the partition.

9 Claims, 5 Drawing Sheets

HORIZONTALLY ORIENTED DEMOUNTABLE PARTITION SYSTEM

BACKGROUND OF THE INVENTION

1. Field of the Invention

This invention relates to demountable partitions, and, more particularly, to demountable partition systems having horizontally oriented panels and bands for wire management and attachment of wall-supported furniture.

2. The Prior Art

To provide the maximum of flexibility, modern building interior spaces, especially offices, are fitted with prefabricated, demountable partition systems. Typically, these systems comprise framing components, such as studs, floor runners, ceiling runners, window frames and door frames, and wall panels supported by the framing. One such system is sold under the trademark ULTRAWALL by USG Interiors, Inc., of Chicago, Ill.

Heretofore, partition systems of the type described above have been oriented vertically, i.e., the longest dimension of the panels and the joints between the longest edges of the panels run from floor to ceiling. Since these panels are usually fabricated in predetermined widths, especially 24 inch or 30 inch, walls constructed of such panels take on a pattern of regularly spaced, numerous vertical lines. In enclosed offices especially, the effect of the vertical lines is that the room is visually perceived to be smaller than its true size.

Demountable partitions are used as support for furniture. Conventionally, the vertical joints between panel edges are provided with studs, standards or the like that are engageable with brackets which support shelves, cabinets, desks, countertops, etc. On such construction is disclosed in my U.S. Pat. No. 4,570,390. Because the bracket-engaging standards are vertical and spaced according to predetermined panel widths, the furniture must also be provided in corresponding preselected widths. While acceptable for many installations, the dimensional and locational restrictions imposed by such vertically oriented constructions significantly limit the interior layouts obtainable and furniture designs usable therewith.

Another consideration in modern office design is the routing of communication and power lines. Electrical service may be needed at desk level and above, such as for under-cabinet light fixtures. Rapidly-evolving telecommunications and computer technology may call for frequent upgrading of these and other types of cables. Preferably, demountable partition system should provide the capability for easy installation, routing and upgrading of these lines.

Thus, there are unmet needs for demountable partition systems that are flexible, visually appealing, less dimensionally modular and adaptable to changing office technology.

SUMMARY OF THE INVENTION

The present invention meets the aforemention needs by providing a demountable parition system with horizontal lines, capable of suporting hang-on furniture at any point along its width, and adapted for routing wires to any location.

The invention provides a partition construction comprising: a substructure; a runner extending generally axially horizontal, overlying and affixed to the substructure, the runner having upper and lower, spaced apart, generally parallel edges and further comprising first panel edge engaging means disposed along the upper runner edge, second panel edge engaging means disposed along the lower runner edge, a runner web disposed between the upper and lower runner edges, the web and upper and lower runner edges forming a recess, means disposed along the recess for engaging a cap, a first wall panel disposed above the runner and having a lower edge engaging the first edge engaging means of the runner; a second wall panel disposed below the runner and having an upper edge engaging the second edge engaging means of the runner; and a cap extending along the runner web and engaging the cap engaging means of the runner.

In installation, the runners are affixed horizontally, overlyingly to a substructure, usually a framework of studs. Upper panels are installed by engaging the lower edges with the upper edge of the runners, typically by flanges on the runner fitting in grooves in the panel edges or by screwing the panel edges to the runner. Lower panels are installed in similar fashion. Then a cap is placed over the runner, between the panel edges. The cap snap-fits in place, thus covering the runner and providing an eye-appealing horizontal band which may be finished to match or contrast with the wall panels.

The recess formed behind the cap may be used for providing electrical service or routing wires or cables. Special provisions for this are disclosed.

Furniture components and supports therefor may be hung from or attached to the wall at any location along the lengths of the runners. Reinforcing channels affixed within the recess strengthen the structure and are engageable with a variety of brackets. The furniture components may placed on the wall without regard to the framing behind or the location of the vertical joints between wall panels.

In each of FIGS. 3 through 6, partition and furniture structure on the opposite face of the wall is shown.

DESCRIPTION OF THE PREFERRED EMBODIMENTS

Figure 1:
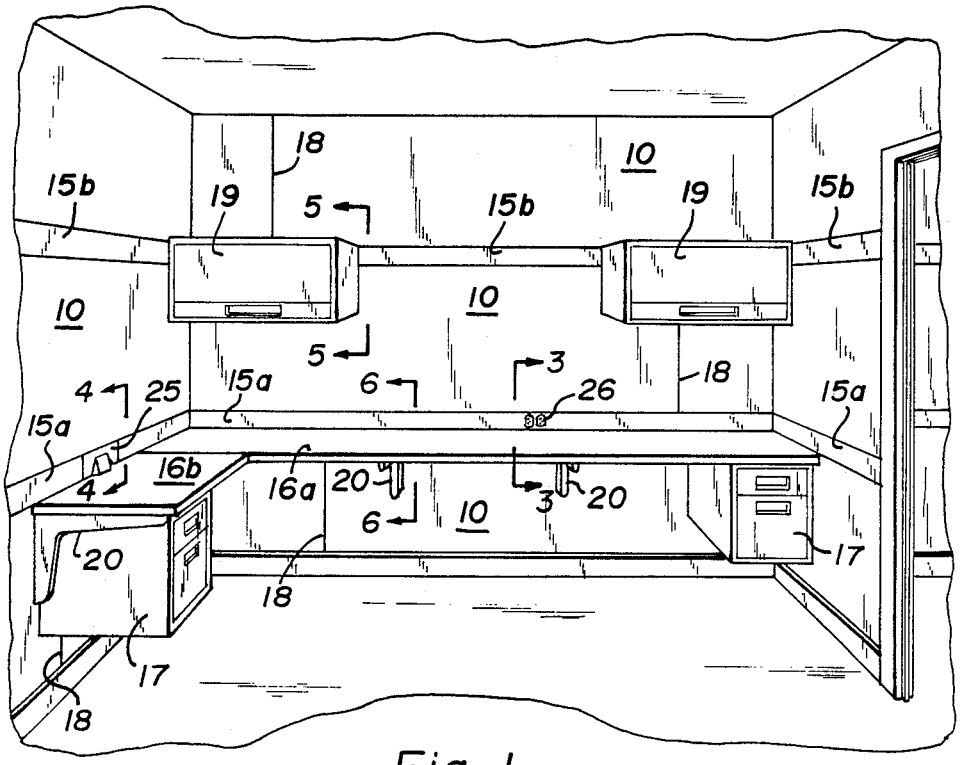
FIG. 1 is a front elevational, perspective of an office room having partition structures according to the invention with furniture components mounted thereon.
Figure 2:
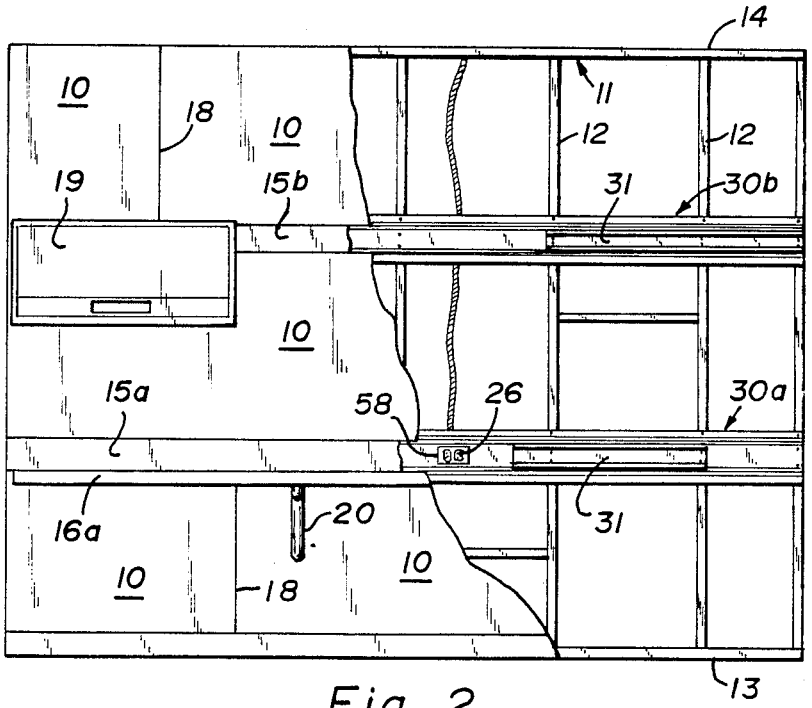
FIG. 2 is an elevational view of a partition structure similar to that shown in FIG. 1 with parts broken away.

By way of disclosing preferred embodiments of the invention, and not by way of limitation, there is shown in FIGS. 1 and 2 an office room with rearward and side walls constructed of wall panels 10 overlying a generally upright substructure. The substructure is a framework 11 of vertical studs 12 and ceiling and floor runners 13, 14.

The wall panels 10 are oriented horizontally, i.e., with their faces vertical but their longest dimension horizontal. Between adjacent horizontal course of wall panels there are elongated, parallel caps 15*a*, 15*b*. The lower caps 15*a* are disposed at about desktop level; the upper caps 15*b* at about eye level. Along the lower caps 15*a*, desktops 16*a* and 16*b*, cantilevered brackets 20 and drawers furniture components 17 are supported by or hung from the partition. Along the upper caps 15*b*, cabinet furniture components 19 are supported by or hung from the partition. Note that the vertical joints 18 between wall panel ends do not coincide with the ends of the furniture components or brackets. Also, the desktop 16*a* is a continuous surface from wall to wall.

In the band formed by cap 15*a* of the left wall (FIG. 1) there is provided a hooded electrical outlet 25. In the band formed by cap 15*a* of the rear wall there is provided an electrical power outlet 26 protruding through holes formed in the cap 50.

As shown in FIG. 2, overlying the framing 14 of the wall substructure are lower and upper runners 30*a* and 30*b*, to be more fully described below. The runners 30*a*, 30*b* extend generally axially horizontally, disposed generally between the spaced apart, parallel adjacent horizontal edges of the wall panels 10. In the fully installed partition, the runners 30*a*, 30*b* are concealed by the caps 15*a*, 15*b*. At selected locations, channels 31 are affixed with the rails for additional structural strength.

Figure 3:
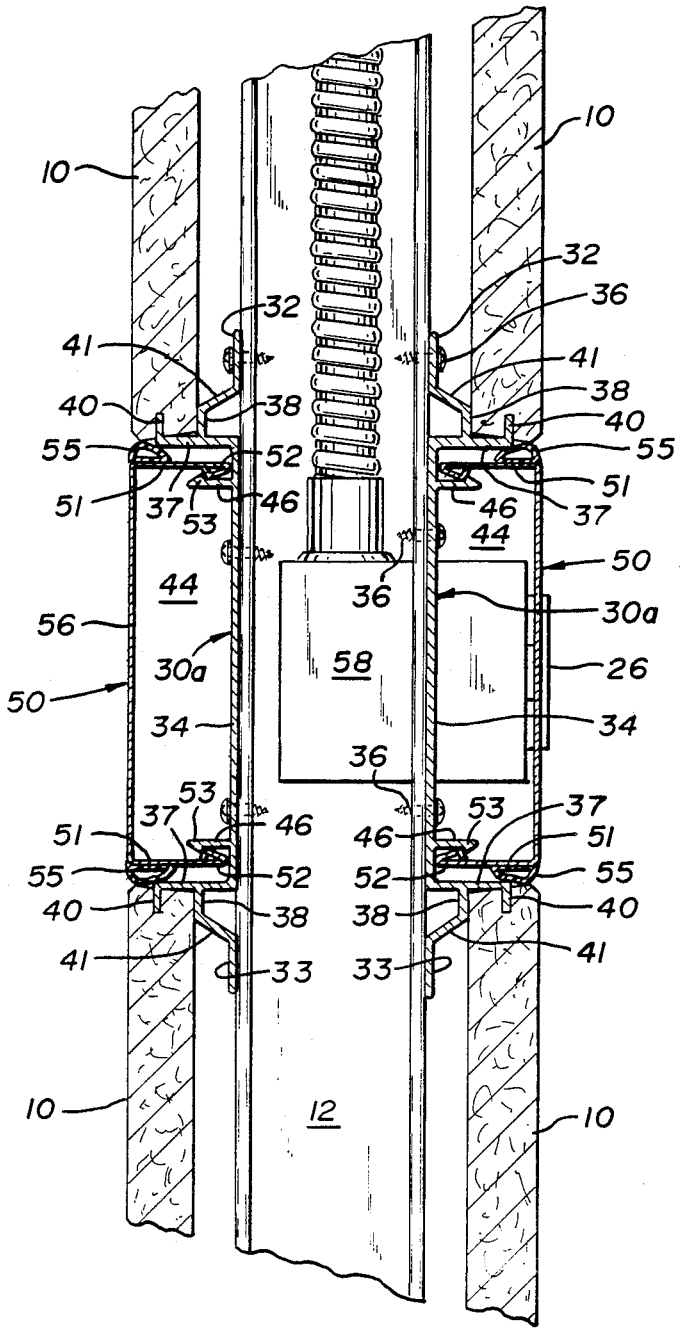
FIG. 3 is a side, elevational, sectional view taken substantially along the line 3—3 of FIG. 1, the desktop structure not being shown.

In FIG. 3, a typical runner 30*a* is seen to comprise generally an upper edge 32, a lower edge 33, and a web 34 disposed between the edges 33 and 32. The runner overlies the studs 12 and is attached thereto by screws 36, although other suitable fasteners may be used as well as other types of substructures, e.g. existing finished walls.

Along the upper and lower edges of the runner are formed panel edge engaging means. In this preferred embodiment, each panel engaging means includes a horizontally, outwardly extending shelf 37, vertically extending buttress walls 38 extending vertically from an intermediate portion of the shelf 37, and a flange 40 disposed vertically along the outer edge of the shelf 37 and adapted to engage a groove or kerf formed in the horizontal edge of the adjacent wall panel 10. The inside edge portions of the panels 10 rest against the buttress walls 38 with edge grooves engaging the flanges 40. Also formed in the panel engaging means of the runners are ramp walls 41 disposed between the buttress walls 38 and the panel edges 33. These ramp walls 38 provide a camming action to assist in properly seating the panels in engagement with the flanges 40.

In the space between the upper and lower panel engaging means and the runner web 34, there is defined a recess 44. At the upper and lower extents of the web 34 within the recess are provided cap engaging means in the form of legs 46 extending from the web into the recess 44 space. Generally C-shaped, channel-like caps 50 extend between the adjacent, spaced-apart edges of the wall panels. The caps 50 cover the recess 44 and conceal the runners 30*a* from view. The edges of the legs 51 of the caps 50 are formed with detents 52 which engage similar detents 53 on the ends of the runner legs 46, thereby holding the caps in place. The corners edges of the caps are provided with resilient strips 55 which press against the adjacent panel edges, thus forming a tight joint. If desired, the caps 50 may be provided with a cover of fabric or other material to match or contrast with the wall panel finish.

Also shown in FIG. 2, there is an electrical service box 58 which is fitted in a hole in the runner 30*a* and having outlets 26 protruding through the cap 50.

Figure 4:
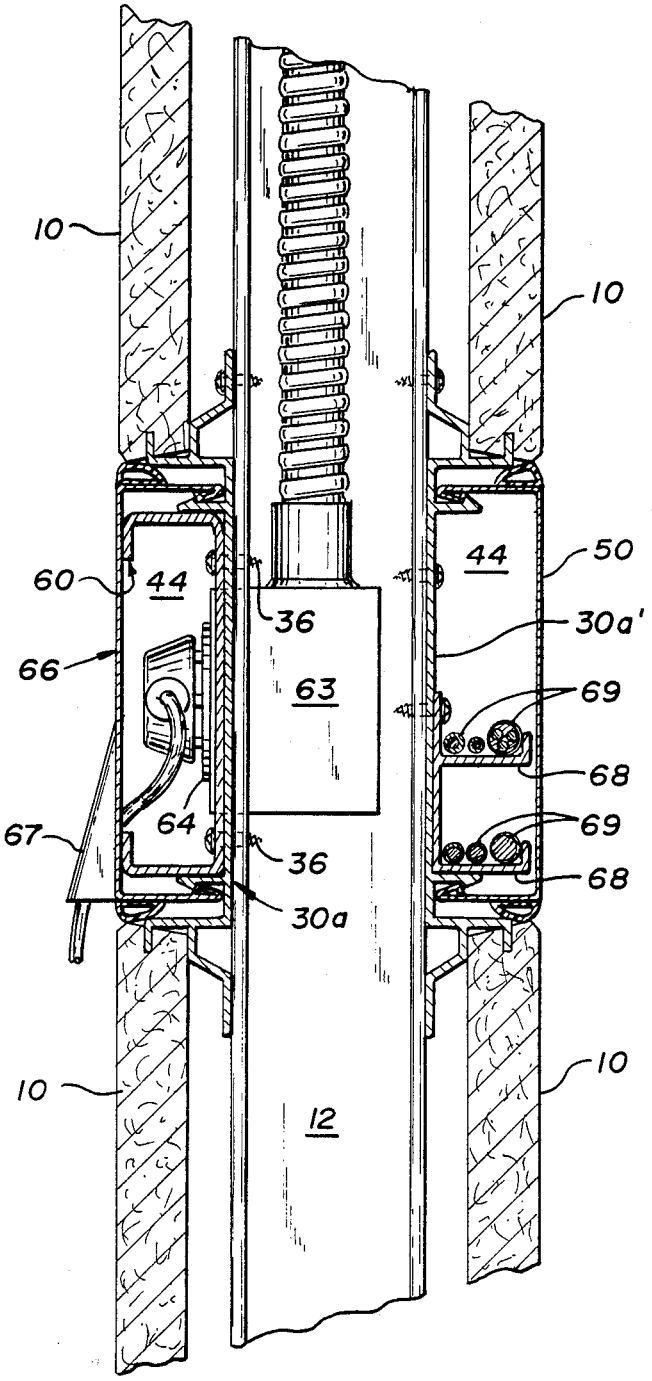
FIG. 4 is a side, elevational, sectional view taken substantially along the line 4—4 of FIG. 1, the desktop structure not being shown, and further depicting an alternate embodiment of the runner.
Figure 5:
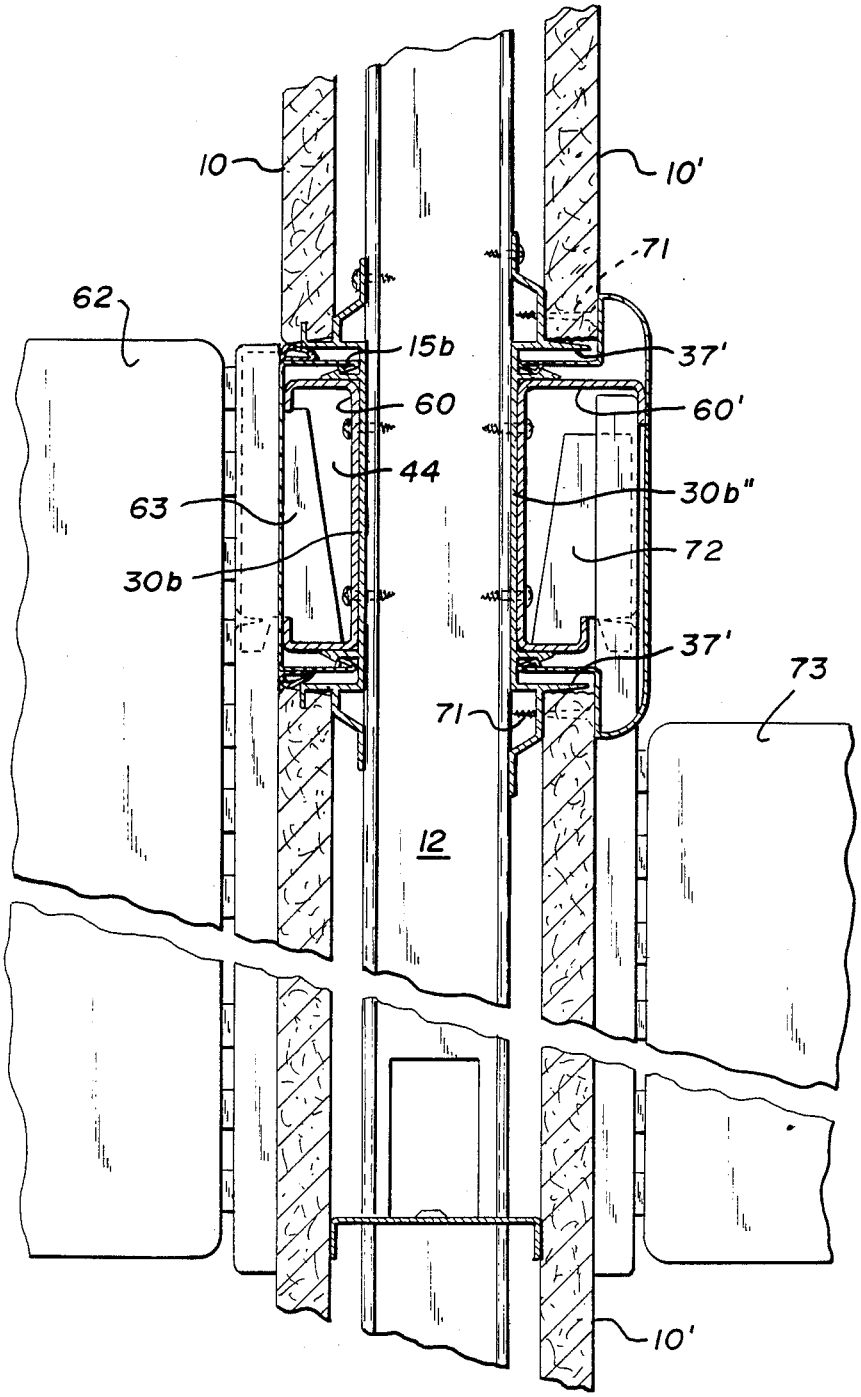
FIG. 5. is a side, elevational, sectional view taken substantially along the line 5—5 of FIG. 1, also depicting an additional alternate embodiment of the runner.

In FIG. 4, at the left, is shown a construction according to the invention in which a reinforcing channel 60 has been installed, disposed in the recess, affixed by screws 36 to the runner and the framing behind. The channel 60 adds additional strength to the partition structure, particularly at locations where it is desired to hang modular furniture components, and further provides a means for engaging support brackets. The channels 60 are provided in predermined lengths sufficient to span at least two studs 12. For example, for studs on 24 inch centers, the channels 60 may be advantageously provided in 36 inch lengths. Referring briefly to FIG. 5, left side, a cabinet component 62 is hung on the wall by means of a hanging bracket 63 which hangs on the lower leg of the channel 60.

Referring again to FIG. 4, at the left there is shown an electrical box having outlets 64 which protrude through the runner 30*a* and the channel 60 into the recess 44. A special cap section 66 with a hood 67 is provided to enable wires to reach from the outlets 64, through the hood 67 outside the wall to a desk surface or wherever desired.

At the right of FIG. 4, a variation of the runner 30*a*′ is shown, having two ledges 68 extending outwardly from the runner web into the recess 44. Electrical and communications wires and cables lie on the ledges, supported and guided thereby, and protected and concealed within the recess.

Referring again to FIG. 5, left side, a bracket 63 extends into the recess 44, hooking onto the lower flange of the channel 60. The cap 15*b* is either interrupted or formed with holes or slots for allowing the bracket to pass therethrough. The portion of the bracket 63 lying outside the wall surface is suitably designed according to the attachments needed for the cabinet 62 or other furniture component. Note that the placement of the bracket 63 along the channel is independent of the location of the studs 12 or the vertical joints between wall panels 10.

At the right side of FIG. 5, there are shown additional variations of the preferred embodiments. The wall panels 10′ have plain edges and are attached to the panel edge engaging means of runner 30″ by screws 71. The shelves 37′ of the runner are not flanged. The cap 15′ is formed to conceal the screws 71, and to allow for a channel 60′ having unequal length legs. The bracket 72 extends downwardly from the cap 15′, supporting a cabinet 73 hanging below the level of the cap and runner.

Figure 6:
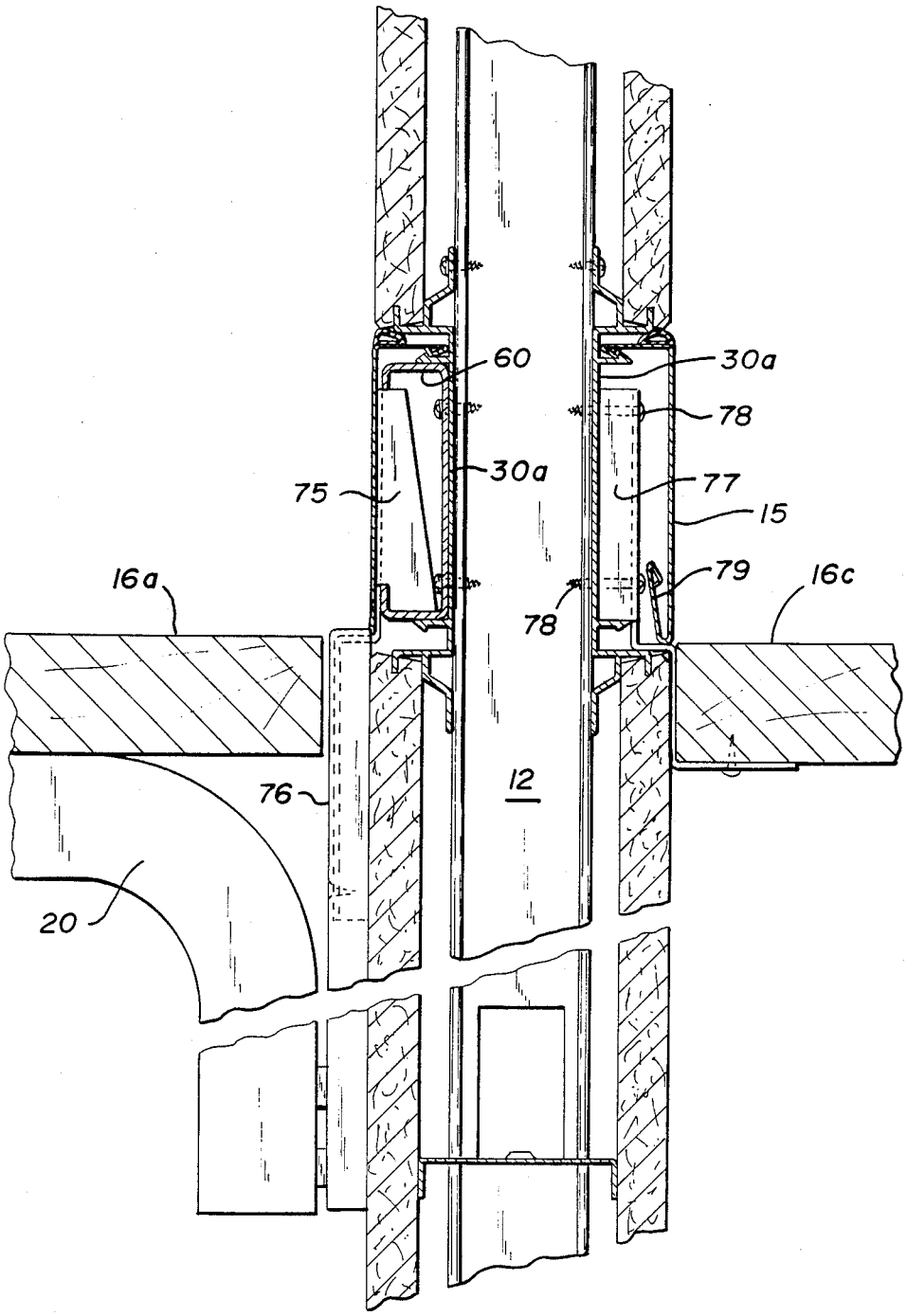
FIG. 6 is a side, elevational, sectional view taken substantially along the line 6—6 of FIG. 1.

FIG. 6 illustrates further uses and embodiments of the invention. At the left, a shelf, desktop or table 16*c* is supported from below by a cantilever bracket 20. A bracket 75 engaging the channel 60 as described above extends downwardly, engaging an attachment device 76 which, in turn, engages the cantilever bracket 20.

At the right of FIG. 6, a shelf or desktop 16*a*′ for lighter duty is supported by a bracket 77 which fastens to the runner 15*a* with screws 78. A portion of the lower leg 79 of the cap 15 is bent upwardly to avoid interference with the bracket 77. Note again that the desktops and shelves are supported without dependence on the framing configuration or the location of the vertical joints between wall panels.

Suitable materials include extruded aluminum for the runners and steel for the channels. The cap may be of plastic if desired.

While several particular embodiment of this invention have been described, it will be understood that the invention may be modified within the scope and spirit of the appended claims.

What is claimed is:

1. A partition construction comprising:

a substructure;

a runner extending generally axially horizontal, overlying and affixed to the substructure, the runner having upper and lower, spaced apart, generally parallel edges and further comprising first panel edge engaging means disposed along the upper runner edge, second panel edge engaging means disposed along the lower runner edge, a runner web disposed between the upper and lower runner edge, the web and upper and lower runner edges forming a recess, means disposed along the recess for engaging a cap, a first wall panel disposed above the runner and having a lower edge engaging the first edge engaging means of the runner;

a second wall panel disposed below the runner and having an upper edge engaging the second edge engaging means of the runner; and a cap extending along the runner web and engaging the cap engaging means of the runner.

2. The construction of claim 1 wherein said first and second edge engaging means each comprise an outwardly extending shelf.

3. The construction of claim 2 said first and second edge engaging means each further comprise a flange extending vertically from said shelf.

4. The construction of claim 1 wherein said runner further comprises ledge means extending from said web into said recess.

5. The construction of claim 1 wherein said cap fits into the space between the lower edge of said first wall panel and the upper edge of said second wall panels and covers the recess.

6. The construction of claim 1 further comprising a C-shaped, outwardly-opening channel disposed in said recess and affixed to the substructure.

7. The construction of claim 6 further comprising bracket means for supporting furniture components, said bracket means engaging said channel.

8. The construction of claim 1 wherein said cap engaging means comprises first and second legs extending outwardly from the runner web within said recess near said first and sceond panel edge engaging means, respectively.

9. The construction of claim 5 further comprising resilient strips on the cap adapted to press against said wall panel edges.

* * * * *